United States Patent [19]

Naganuma et al.

[11] 4,175,958

[45] Nov. 27, 1979

[54] DRY PLANOGRAPHIC PRINTING METHOD AND PLATE MADE BY ELECTROPHOTOGRAPHIC METHOD USING CONDUCTIVE TONER

[75] Inventors: Tsutomu Naganuma, Funabashi; Hisao Hoshi, Tokorozawa; Hiroji Kumagai, Narashino; Kaneki Yoshida, Kodaira, all of Japan

[73] Assignee: Toppan Printing Co., Ltd., Tokyo, Japan

[21] Appl. No.: 862,607

[22] Filed: Dec. 20, 1977

[30] Foreign Application Priority Data

Dec. 23, 1976 [JP] Japan ..... 51/155474
Sep. 8, 1977 [JP] Japan ..... 52/108196

[51] Int. Cl.[2] ..... G03G 13/26
[52] U.S. Cl. ..... 430/49; 430/100
[58] Field of Search ..... 96/1, 1.4, 1.5, 33; 101/473, 463; 427/24

[56] References Cited

U.S. PATENT DOCUMENTS 3,918,971 11/1975 Zweig ..... 96/1.4

*Primary Examiner*—John D. Welsh
*Attorney, Agent, or Firm*—Flynn & Frishauf

[57] ABSTRACT

This invention provides a dry planographic printing plate prepared by forming on an electrically conductive support a photoconductive layer composed of a binder and photoconductive powder dispersed in the binder, charging and then image-exposing a resultant photosensitive plate, and finally developing by means of a conductive toner and fixing the conductive toner. This invention also provides a dry planographic printing method including reversal-developing said printing plate by using a toner, transferring the toner to a sheet of transfer material, and then fixing the toner, as well as an apparatus used in said printing method.

4 Claims, 14 Drawing Figures

DRY PLANOGRAPHIC PRINTING METHOD AND PLATE MADE BY ELECTROPHOTOGRAPHIC METHOD USING CONDUCTIVE TONER

BACKGROUND OF THE INVENTION

This invention relates to a dry planographic printing plate and dry planographic printing method as well as an apparatus therefore suitable for production of printed matter in small lots—some 100 to 1,000 copies.

Heretofore, the small offset printing method has extensively been used for the office service, whereas the letterpress printing, gravure printing, and offset printing methods have suitably been employed for producing prints in large lots. This small offset printing, however, requires water and ink, so that it lacks in simplicity of operations.

An object of this invention is to provide a dry planographig printing plate and dry planographic printing method as well as an apparatus therefore capable of securing ease of operations possesed by copying machines and accomplishing with ease the printing of something like 100 to 1,000 copies.

The above and other objects of this invention will be apparent in the following detailed description of illustrative embodiments thereof which is to be read in connection with the accompanying drawings, wherein FIGS. 1 to 5 show the dry planographic printing plate of the invention, and FIGS. 6 to 9 are illustrative of the dry planographic printing method in which said planographic printing plate is employed.

DETAILED DESCRIPTION

Figure 1:
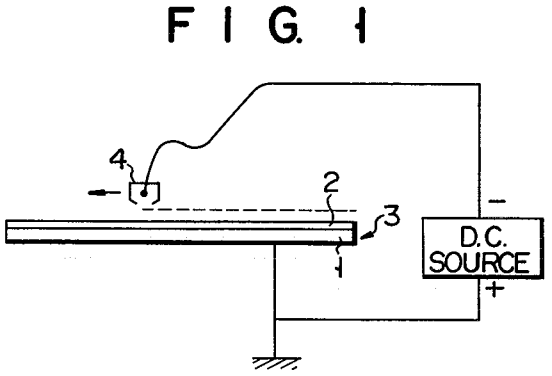
FIG. 1 is a diagrammatic view showing a step in which a photosensitive plate is uniformly charged.
Figure 2:
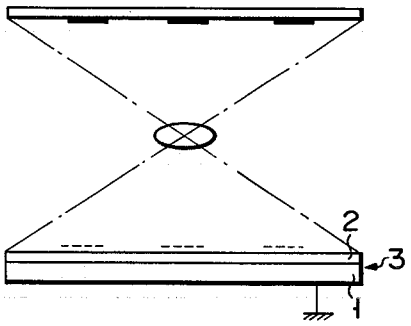
FIG. 2 is a diagrammatic view showing a step in which a latent electrostatic image is formed by exposure.
Figure 3:
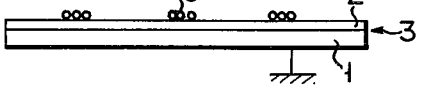
FIG. 3 is a diagrammatic view showing a photosensitive plate developed by means of a conductive toner.
Figure 4:
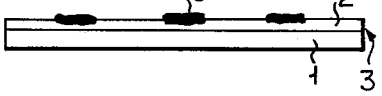
FIG. 4 is a diagrammatic view showing a fixed photosensitive plate.
Figure 5:
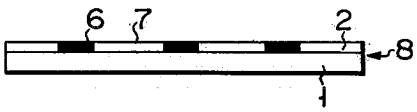
FIG. 5 is a diagrammatic view showing a dry planographic printing plate composed of an electrically conductive portion and an electrically insulating protion.

Now there will be described in detail the dry planographic printing plate and dry planographic printing method of the invention with reference to the accompanying drawings. A photosensitive plate 3 composed of an electrically conductive support 1 and a photoconductive layer 2 formed of photoconductive powder dispersed in a resin binder is uniformly charged by means of a corona charger 4, as shown in FIG. 1, then image-exposed to form a latent electrostatic image, as shown in FIG. 2, and thereafter developed by using a conductive toner 5, as shown in FIG. 3. Further, the plate 3 is fixed to cause the conductive toner 5 to penetrate into the photoconductive layer 2, as shown in FIG. 4, thereby preparing a dry planographic printing plate 8 composed of an electrically conductive portion 6 and an electrically insulating portion 7, as shown in FIG. 5.

Figure 7:
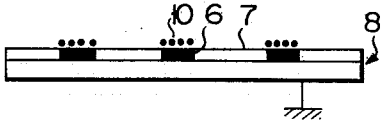
FIG. 7 is a diagrammatic view showing a step in which reversal-development is accomplished by means of a toner.
Figure 6:
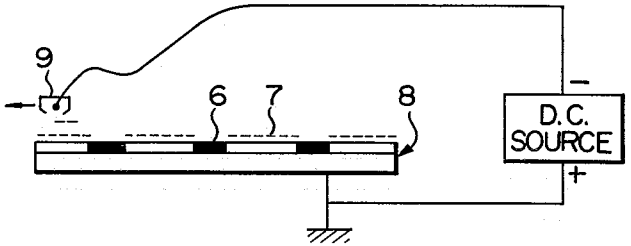
FIG. 6 is a diagrammatic view showing a step in which the dry planographic printing plate is uniformly charged and a latent electrostatic image is formed.
Figure 8:
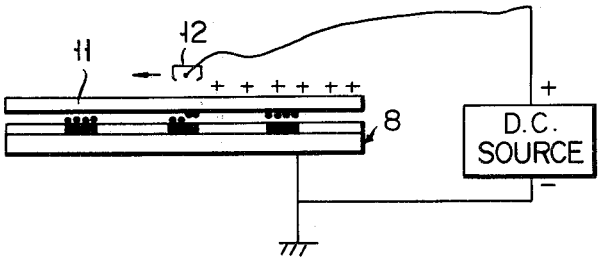
FIG. 8 is a diagrammatic view showing a transfer process.
Figure 9:
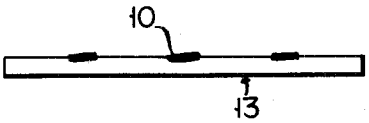
FIG. 9 is a diagrammatic view showing a transfer material with the toner fixed.

Subsequently, there will be mentioned the dry planographic printing method employing the dry planographic printing plate 8. The dry planographic printing plate 8 is uniformly corona-charged in a dark place by means of a corona charge 9 to charge the electrically insulating portion 7 positively or negatively, thereby forming a latent electrostatic image, as shown in FIG. 6. Then, as shown in FIG. 7, the printing plate 8 is reversal-developed by the magnetic brush method, cascade method, etc. using a toner 10 having a charge of the same polarity as that of the charge on the electrically insulating portion 7, thus sticking the toner 10 to the electrically conductive portion 6. Subsequently, as shown in FIG. 8, a sheet of transfer material 11 such as paper is placed on the dry planographic printing plate 8 with the toner 10 stuck thereto, and the toner 10 on the dry planographic printing plate 8 is electrostatically transferred to the transfer material 11 by applying to the back of the transfer material 11 an electric charge or field of polarity opposite to that of the toner 10 by means of a corona charger 12 or conductive roller. Thereafter, the toner 10 on the transfer material 11 is fixed and a print 13 is obtained, as shown in FIG. 9. A large number of prints may be obtained by repeating the above processes for dry planographic printing.

If the dry planographic printing plate 8 is developed by using a toner with a charge of polarity opposite to that of the charge with which the printing plate 8 is corona-charged, then the toner will adhere to the electrically insulating portion 7. Naturally, the dry planographic printing plate 8 may also be used as a hard copy, besides as a printing plate.

The materials available for the electrically conductive support of the invention may include metal plates, such as aluminium, iron, nickel, and brass plates, as well as multilayer films or paper prepared by vacuum-evaporating or laminating metals, or conductive-treated paper. There is generally known a method for the conductive treatment of paper in which a combination of binder, pigments, and conductive agent is applied to a sheet of paper. The binder may be selected from polyvinyl alcohol, modified starches, latices, and casein, while the pigments may include clay, calcium carbonate, titanium dioxide, etc. As for the conductive agents, they include inorganic electrolytes, surface active agents, inorganic conductive materials, and polyelectrolytes, more specifically sodium chloride, lithium chloride, calcium chloride, magnesium chloride, and sodium sulfate as the inorganic electrolytes. The surface active agents include alkyltrimethyl-ammonium salt, alkyldimethyl-ammonium salt, alkyldimethylbenzylammonium salt, alkylpyridium salt, etc. As for the inorganic conductive materials, they include carbon black, graphite, metal powder, such as copper, nickel, aluminium, and silver, hygroscopic materials, such as silica and alumina, and metal compounds, such as copper iodide. Further, the polyelectrolytes include polydimethyldiallyl-ammonium chloride, polyvinylbenzyltrimethylammonium chloride, styrene sulfonic acid soda, etc.

Meanwhile, the photoconductive powder available for the invention may be selected from zinc oxide, cadmium sulfide, cadmium selenide, cadmium telluride, copper-phthalocyanine, etc.

As for the resin binder, it may be selected from materials including polystyrene, acrylic resin, modified acrylic resin, styrene-butadiene resin, polyvinyl acetate, silicone resin, alkyd resin, and expoxy resin, as well as blends of two or more kinds of these resins. Sensitizing dyes such as rose bengal may effectively be added to the binder for improved sensitivity.

Further, the conductive toner 5 may be composed of any suitable conductive powder, such as copper, iron, aluminium, silver, zinc, magnetite, copper oxide copper chloride, copper iodide, silver oxide, cobalt oxide, indium oxide, and carbon black, and any suitable resin selected from polystyrene, epoxy resin, polyvinyl chloride, polyvinylbutyral, and ethylene-vinyl-acetate copolymer, though a conductive one-component toner composed of magnetite, carbon black, and thermoplastic resin is most generally used with the conventional carrierless development method.

The particle size of the conductive toner ranges generally from 1 to 50$\mu$, preferably from 5 to 30$\mu$, while its specific resistance should be $10^{10}$ $\Omega$cm to 10 $\Omega$cm.

Alternatively, there may be also used a conductive press-fused toner composed of paraffin wax, ethylene-vinyl-acetate copolymer, carbon black, magnetite, etc. In this case the toner is generally fixed under a pressure of 200 kg/cm$^2$ by means of a polished steel roller.

Otherwise, there may be used a conductive microcapsular toner including a magnetic liquid or semisolid contained within a double wall having a colloidal inner wall portion and an outer wall portion composed of a mixed system of a hydrophobic resin and a pigment or dye, the outer wall portion having a volume resistivity less than $10^{10}$ $\Omega$cm.

There will now be described the dry planographic printing plate and dry planographic printing method according to an alternative embodiment of the invention. This planographic printing plate is prepared by charging and image-exposing a photosensitive plate including an electrically conductive support and a photoconductive layer formed on the support, the photoconductive layer being composed of a resin binder and a photoconductive powder dispersed in the binder then developing the photosensitive plate by means of a conductive toner and fixing the conductive toner, and finally flash-irradiating the whole surface of the photosensitive plate by means of a xenon flash lamp.

Figure 10:
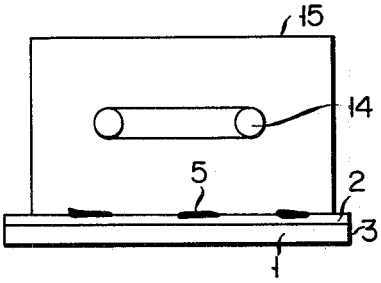
FIG. 10 is a diagrammatic view showing a step in which flash-irradiation is conducted by means of a xenon flash lamp, in connection with the dry planographic printing plate and printing method according to another embodiment of the invention.

As for the dry planographic printing method employing the aforesaid dry planographic plate, it includes charging the surface of a dry planographic printing plate, reversal-developing the printing plate by means of a toner, transferring the toner to a transfer material, and fixing the toner; the dry planographic printing plate being prepared by charging and image-exposing a photosensitive plate including an electrically conductive support and a photoconductive layer formed on the support, the photoconductive layer being composed of a resing binder and a photoconductive powder dispersed in the binder, then developing the photosensitive plate by means of a conductive toner and fixing the conductive toner, and finally flash-irradiating the whole surface of the photosensitive plate by means of a xenon flash lamp. The xenon flash lamp is of a flash type, and the details of irradiation vary with the irradiation area and the set distance between the light source and the irradiation surface; a light with a wavelength of 400 to 1,500 nm is applied for $10^{-4}$ to $10^{-2}$ sec. and an energy of 3.0 to 12.0 Wsec./cm$^2$ is instantaneously irradiated, in general. In flashing the xenon flash lamp at the conductive toner fixed on the photoconductive layer of a 100 mm$\times$100 mm photosensitive plate, for example, an electronic flash discharge tube 14—with 200 mm interelectrode distance, 12 mm diameter, xenon gas quartz-enclosed under a pressure of 700 mmHg, and 1,200 Wsec. maximum input energy—is set in a position 20 mm distant from a reflector plate 15 as well as from the surface of the photosensitive plate 3, as shown in FIG. 10. The charge on a 3,500 $\mu$F condenser with the charging voltage of 700 V connected to the discharge tube 14 is drastically discharged for nearly $10^{-3}$ sec. by applying a voltage of approximately 10,000 V to the tube wall, and a light energy of approximately 6.0 Wsec./cm$^2$ is applied to the photosensitive plate 3, thereby allowing the fixed conductive toner 5 further to fuse and penetrate into the photoconductive layer 2.

Accordingly, the electrical conductivity of the electrically conductive portion of the dry planographic printing plate which is obtained by flashing the xenon flash lamp is substantially higher than that of portions subjected to no such flashing, so that there may be obtained high-precision prints with a striking contrast by applying the flash irradiation to the dry planographic printing method.

Figure 11:
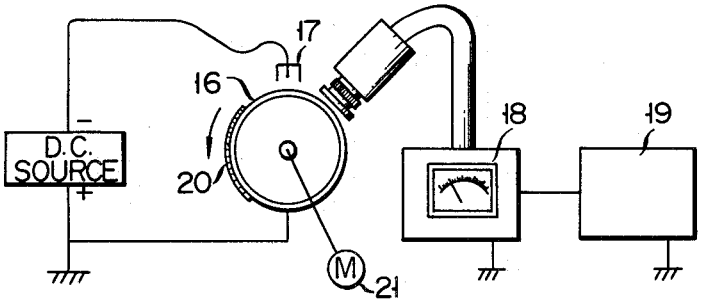
FIG. 11 is a diagrammatic view showing a testing apparatus for measuring the surface potential of the dry planographic printing plate to check the xenon flash lamp for efficiency.

Meanwhile, we conducted the following experiment to see how the electrical conductivity of the conductive portion of the dry planographic printing plate varies when such portion is subjected to the flash irradiation by the xenon flash lamp. First, the testing apparatus used includes an earthed aluminium drum 16 with 200 mm diameter, and a corona charging device 17 and a surface potential meter (SSVII-40 from Kawaguchi Electric Works) 18 attached to the metal drum 16, the surface potential meter 18 being connected to a recorder (EPR-2TB from TOA Electronics Ltd). 19, as shown in FIG. 11.

As for the testing method, it includes steps of mounting a 150 mm$\times$150 mm sample 20 on the metal drum 16, rotating the drum 16 in a direction indicated by the arrow at a speed of 30 rpm by means of a motor 21, charging the sample 20 by the corona charging device 17 and measuring and recording the amount of charge (surface potential) by means of the surface potential meter 18 and the recorder 19 respectively.

The larger the amount of charge (surface potential) the lower the electrical conductivity; the smaller the amount of charge the higher the conductivity. The test results are as follows. A solid image was formed on a zinc oxide coated paper as a sample by means of a conductive toner ($10^6$ $\Omega$cm specific resistance) composed of magnetite polystyrene, and carbon black, which was fixed by means of a hot roller (160° C.). Then the photosensitive plate was mounted on the metal drum 16 of the apparatus of FIG. 11 and subjected to a measurement according to the aforesaid method, and consequently the surface potential was found out to be −46 V. Subsequently, 1,200 Wsec. flash irradiation was applied to the sample (fixed zinc oxide coated paper) at a distance of 20 mm therefrom by using the xenon flash lamp from Comet Corporation as shown in FIG. 10, and the surface potential was determined to be −10 V according to the same testing method.

Further, a solid image was formed on a zinc oxide coated paper as another sample by means of a conductive press-fused toner ($10^6$ Ωcm specific resistance) composed of magnetite, carbon black, paraffin wax, and ethylene-vinyl-acetate copolymer, which was press-fused (inter-roller pressure: 200 kg/cm$^2$). The sample (press-fussed zinc oxide coated paper) was mounted on the metal drum 16 of the apparatus of FIG. 11, and its surface potential was measured according to the aforesaid method, proving to be −15 V. Subsequently, 1,200 Wsec. flash irradiation was applied to the sample (press-fused zinc oxide coated paper) at a distance of 50 mm therefrom by using the xenon flash lamp from Comet Corporation as shown in FIG. 10, and the surface potential was determined to be −7 V according to the same testing method. When the non-image portion of the zinc oxide coated paper was measured by means of the apparatus of FIG. 11, the surface potential proved to be −450 V, which varied somewhat with the way of fixation-heat or pressure fixation. The surface potential would not, however, be affected by the flash irradiation by means of the xenon flash lamp, remaining at the same level. The testing temperature and humidity were 26° C. and 68% respectively.

Thus, the flash irradiation effect of the xenon flash lamp is immense. When flashing of the xenon flash lamp was tried omitting the process for fixation, there were obtained no satisfactory results; cohesion of the conductive toner itself took place before its penetration into the photosensitive layer of the photosensitive plate.

Figure 12:
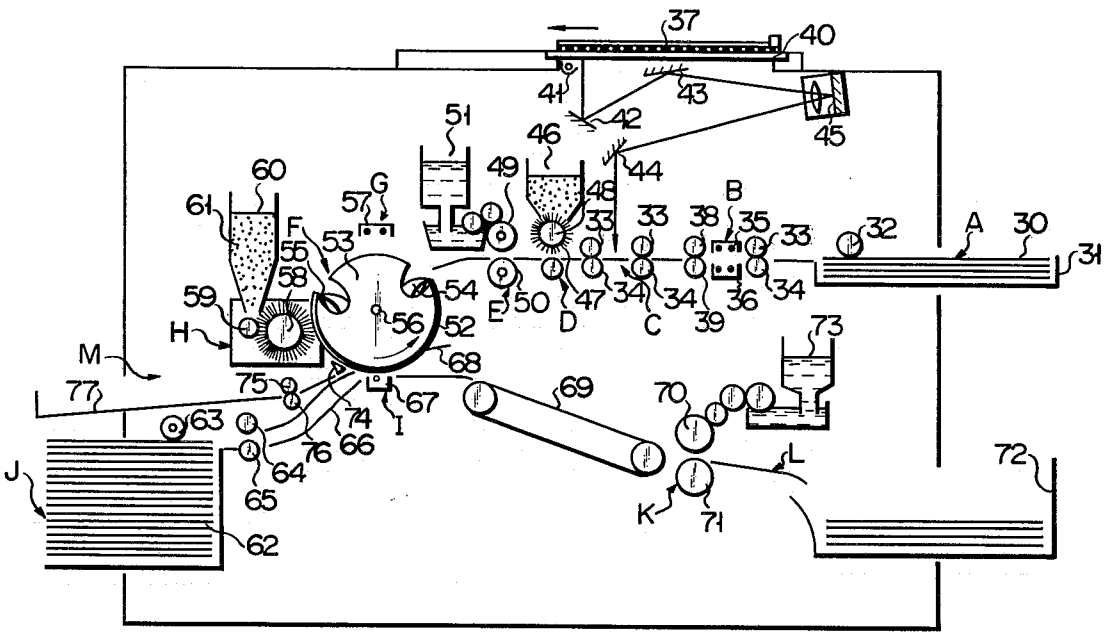

There will now be described the dry planographic printing apparatus of the invention. In a dry planographic printing apparatus according to a first embodiment, as shown in FIG. 12, a photosensitive plate 30 similar to the aforesaid one is cut into a predetermined size and fed to a photosensitive plate feed mechanism A, and a sheet of photosensitive plate 30 placed on a photosensitive plate feed stand 31 is guided by a feed roller 32 and guide rollers 33 and 34 and delivered to a charging mechanism B. The photosensitive plate 30 delivered to the charging mechanism B is charged by corona chargers 35 and 36, and then transmitted to an exposure mechanism C, where it is exposed to a reverse image of an original 37 to be printed. The exposure mechanism C, as shown in FIG. 12, is composed of an original holder 40 to move simultaneously with the photosensitive plate 30 being carried at a constant speed by means of guide rollers 38 and 39, and an optical system to form on the photosensitive plate 30 the reverse image of the original 37 placed on the original holder 40. Numeral 41 denotes a light source to illuminate the original, while 42, 43 and 44 designate mirrors and 45 designates an inmirror lens. The photosensitive plate 30, having a latent electrostatic image formed thereon by the exposure mechanism C, is sent to a subsequent development mechanism D, where it is developed. This development mechanism D is a magne-dry-type carrierless development mechanism in which a conductive toner 47 similar to the aforesaid one contained in a hopper 46 is supplied to the surface of an aluminum cylinder 48. In this cylinder 48 a magnet rotates at a high speed in a direction opposite to the direction of the movement of the photosensitive plate 30, the conductive toner 47 moving over the surface of the cylinder 48 opposite to the rotation of the magnet accompanying such rotation of the magnet. Thereupon, the conductive toner 47 is brought into contact with the photosensitive plate 30, and the latent electrostatic image on the photosensitive plate 30 is developed. After the development, the photosensitive plate 30 is fed to a fixation mechanism E, where it is fixed by means of hot-press rollers 49 and 50. Each of these hot-press rollers 49 and 50 has a built-in heater controlled by a thermostat or the like. The surfaces of the hot-press rollers 49 and 50 are treated with silicone rubber or Teflon, and besides silicone oil is supplied from a silicone oil reservoir 51, thereby preventing the conductive toner 47 from adhering to the hot-press rollers 49 and 50. The fixed photosensitive plate, that is, dry planographic printing plate 52 is delivered to an earthed metallic plate cylinder 53, where it is attached and fixed to a fixed position on the peripheral surface of the plate cylinder 53 by means of a plate attaching mechanism F in cooperation with cathes 54 and 55. The plate cylinder 53 is mounted on a shaft 56 driven by a suitable power means, and is rotated at a constant speed in the direction indicated by the arrow. Accompanying such rotation of the plate cylinder 53, the dry planographic printing plate 52 fixed to the fixed position on the peripheral surface of the plate cylinder 53 is carried to a charging mechanism G and a toner-development mechanism H. The dry planographic printing plate 52 carried to the charging mechanism G is uniformly charged by a corona charger 57, and the charge on the conductive portion of the dry planographic printing plate 52 escapes to the earthed plate cylinder 53, thereby forming a latent electrostatic image. Meanwhile, the toner-development mechanism H is composed of a magnetic bush 58, a toner supply roller 59, and a toner reservoir 60, the magnetic brush 58 being driven by a suitable power means, a toner 61 being carried on to the surface of the dry planographic printing plate 52 by the magnetic brush 58 for the development of the plate 52. The toner 61 consumed during the development is supplied by the toner reservoir 60, the amount of supply being controlled by the toner supply roller 59.

Subsequently, the developed dry planographic printing plate 52 is carried to a transfer mechanism I accompanying the rotation of the plate cylinder 53. The transfer mechanism I, in cooperation with a paper feed roller 63, guide rollers 64 and 65, and a guide plate 66 of a transfer material feed mechanism J, carries a sheet of transfer material 62 cut into a predetermined size simultaneously with the conveyance of the dry planographic printing plate 52 and at a speed equal to the peripheral speed of the plate cylinder 53, bringing the transfer material 62 into contact with the dry planographic printing plate 52. Thereupon, a corona charger 67 gives the back of the transfer material 62 a corona discharge of polarity opposite to that of the toner 61. The toner-transferred transfer material 61 is then removed from the dry planographic printing plate 52 by means of a pawl 68, transmitted to a toner-fixation mechanism K by means of a conveyor belt 69, fixed by means of heat-fixing rollers 70 and 71, delivered to a delivery mechanism L, and piled up in a delivered transfer material receptacle 72. The heat-fixing rollers 70 and 71 are treated with silicone rubber or Teflon, and the roller 70 is supplied with silicone oil from a silicone oil reservoir 73. Thereafter, the dry planographic printing plate 52 is again carried to the charging mechanism G, and sheets of transfer material 62 are successively subjected to the dry planographic printing by repeating the above-mentioned operations. After a fixed quantity is printed, the dry planographic printing plate 52 is delivered to a plate takeout mechanism M, where it is set free with the catches 54 and 55 opened, removed from the plate cylinder 53 by the operation of a stripper 74, and delivered on to a receiver 77 through plate takeout rollers 75 and 76, thus completing the processes for dry planographic printing.

Figure 13:
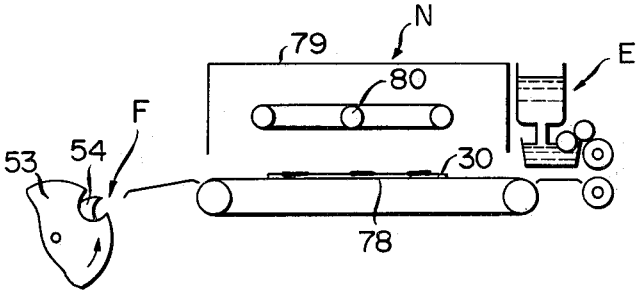
FIGS. 12 to 14 are diagrammatic views for illustrating the dry planographic printing apparatus of the invention.

Now there will be described a dry planographic printing apparatus according to a second embodiment of the invention. This apparatus, as compared with the first apparatus, is more suitable for the production of high-precision prints with a striking contrast. That is, in this second apparatus, a xenon flash irradiation mechanism N for flashing a xenon flash lamp at the whole surface of the fixed photosensitive plate 30, as shown in FIG. 13, is interposed between the fixation mechanism E for fixing the conductive toner 47 to the photosensitive plate 30 and the plate attaching mechanism F for attaching the fixed photosensitive plate 30, i.e., dry planographic printing plate 52 to the plate cylinder 53 of the first apparatus as shown in FIG. 12.

More specifically, the fixed photosensitive plate 30, which has passed through the fixation mechanism E, is delivered by means of a conveyor belt 78 to the xenon flash irradiation mechanism N composed of a reflector plate 79 and a xenon flash lamp 80, and is flash-irradiated by the xenon flash lamp 80 the moment the whole body of the fixed photosensitive plate 30 has come within the range of the reflector plate 79. The flash-irradiated photosensitive plate 30 is then carried to the plate attaching mechanism F, where it is caught by the catch 54 of the plate cylinder 53. The subsequent processes are omitted from the description herein because they are the same as those for the first apparatus.

Now there will be described a dry planographic printing apparatus according to a third embodiment of the invention. For the convenience of description, let it be supposed that the photosensitive plate is a sheet of zinc oxide coated paper, and that the conductive toner used is composed of a conductive powder including a magnetic and carbon black and a resin binder including polystyrene and epoxy resin.

Figure 14:
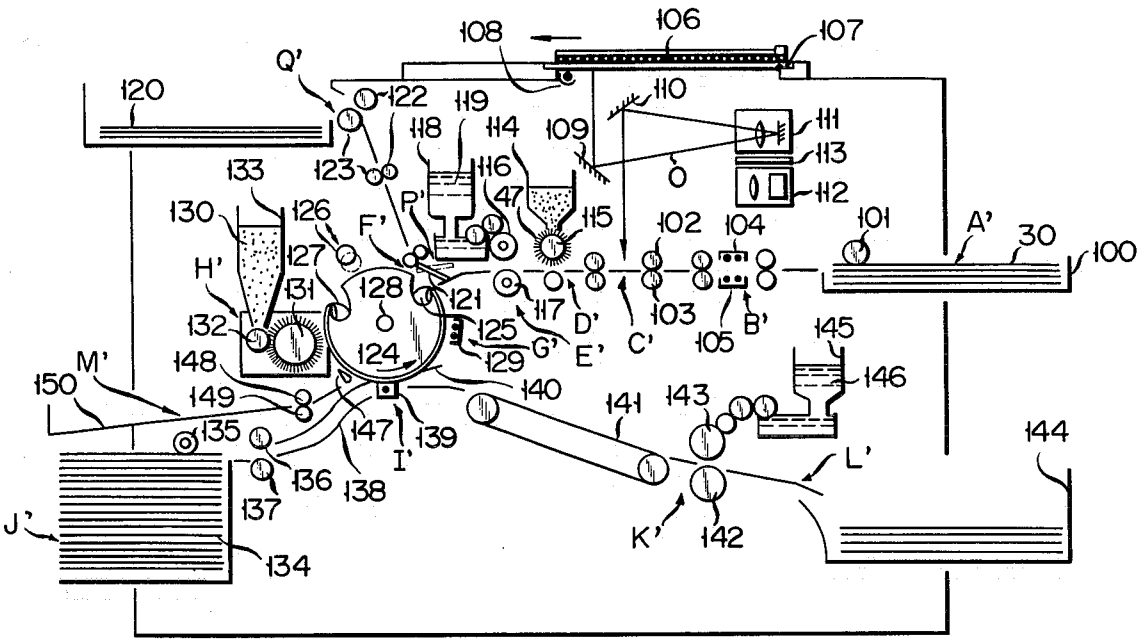

As shown in FIG. 14, the photosensitive plate 30 is cut into a predetermined size and fed to a photosensitive plate feed mechanism A' and a sheet of photosensitive plate 30 placed on a photosensitive plate feed stand 100 is guided by a feed roller 101 and guide rollers 102 and 103 and delivered to a charging mechanism B'. The guide rollers 102 and 103 convey or guide the photosensitive plate 30 to a variety of mechanisms at a fixed speed.

The photosensitive plate 30 delivered to the double-charging mechanism B' is charged by corona chargers 104 and 105 of the charging mechanism B', and then transmitted to an exposure mechanism C', where it is exposed to a normal image (for a hard copy) or a reverse image (for a dry planographic printing plate) of an original 106 to be copied.

The exposure mechanism C', as shown in FIG. 14, is composed of an original holder 107 to move simultaneously with the photosensitive plate 30 being carried at a constant speed by means of guide rollers 102 and 103, and an optical system to form on the photosensitive plate 30 the image of the original 106 placed on the original holder 107.

Numeral 108 denotes a light source to illuminate the original, while 109 and 110 designate mirrors and 111 and 112 designate an in-mirror lens for forming the normal image and an in-prism lens for forming the reverse image respectively. Although FIG. 14 shows a state in which the in-mirror lens 111 is set on an optical axis o (for a hard copy), the lens 111 may be replaced with the in-prism lens 112 by turning the lenses round an axis 113 for the production of the dry planographic printing plate.

The photosensitive plate 30, having a latent electrostatic image formed thereon by the exposure mechanism C', is sent to a subsequent development mechanism D', where it is developed.

This development mechanism D' is a magnedry-type development mechanism in which the conductive toner 47 contained in a hopper 114 is supplied to the surface of an aluminium cylinder 115. In this cylinder 115 a magnet rotates at a high speed in a direction opposite to the direction of the movement of the photosensitive plate 30, the conductive toner 47 moving over the surface of the cylinder 115 opposite to the rotation of the magnet accompanying such rotation of the magnet. Thereupon, the conductive toner 47 is brought into contact with the photosensitive plate 30, and the latent electrostatic image on the photosensitive plate 30 is developed.

After the development, the photosensitive plate 30 is fed to a fixation mechanism E', where it is hot-pressed by means of hot-press rollers 116 and 117, thereby fixing the image-shaped conductive toner 47 stuck to the surface of the photosensitive plate 30. Each of these hot-press rollers 116 and 117 has built-in heater controlled by a thermostat or the like, and their surface temperature is kept at such a level that causes the conductive toner 47 to melt. The surfaces of the hot-press rollers 116 and 117 are treated with silicone resin or Teflon, and besides silicone oil 119 is supplied from a silicon oil reservoir 118, thereby preventing the conductive toner 47 from adhering to the hot-press rollers 116 and 117. The image-fixed photosensitive plate, that is, hard copy 120 or dry planographic printing plate 52 is transmitted to a divergence mechanism P'. This divergence mechanism P' is connected with the axis 113 of the aforesaid optical system for selecting the normal or reverse image. Therefore, in a state to provide the hard copy 120 (where a normal image is formed), a springboard 121 is lowered as shown in FIG. 14, and the photosensitive plate 30, as the hard copy 120, is delivered into and piled up in a normal-image-fixed photosensitive plate delivery mechanism Q' by means of feed rollers 122 and 123. On the other hand, in a state to provide the dry planographic printing plate 52 (where a reverse image is formed), the springboard 121 is raised as indicated by the broken line in FIG. 14, and the dry planographic printing plate 52 is allowed to be carried to a plate attaching mechanism F'. That is, when the dry planographic printing plate 52 is delivered, an earthed metallic plate cylinder 124 catches the plate 52 by means of catch 125, and then rotates slowly in the direction indicated by the arrow. Thereupon, a pressing roller 126 is lowered to the position as indicated by the broken line to press down the dry planographic printing plate 52, and is held as it is until the tail end of the printing plate 52 comes to be caught and fixed by a catch 127. After the dry planographic printing plate 52 has passed, the pressing roller 126 is raised (to the position as indicated by the solid line) and the plate cylinder 124 is stopped.

Meanwhile, the plate cylinder 124 with the dry planographic printing plate 52 attached thereto is mounted on a shaft 128 driven by a suitable power means, and is rotated at a fixed printing speed in the direction indicated by the arrow.

Accompanying such rotation of the plate cylinder 124, the dry planographic printing plate 52 is carried to a charging mechanism G', where it is charged by a corona charger 129. The charger on the conductive portion of the dry planographic printing plate 52 escapes to the plate cylinder 124, the electrically insulating portion alone being charged, and thus a latent electrostatic image is formed.

Subsequently, the dry planographic printing plate 52 is carried to a toner-development mechanism H', which supplies a toner 130 on to the surface of the dry planographic printing plate 52, and develops the latent electrostatic image. Although a magnetic brush type development mechanism is illustrated in FIG. 14, there may also be used the cascade system or any other suitable developing system. The toner-development mechanism H' is composed of a magnetic brush 131, a toner supply roller 132, and a toner reservoir 133, the magnetic brush 131 being driven by a suitable power means, the toner 130 being carried on to the surface of the dry planographic printing plate 52 by the magnetic brush 131 for the development of the plate 52. The toner 130 consumed during the development is supplied by the toner reservoir 133, the amount of supply being controlled by the toner supply roller 132.

Meanwhile, the developed dry planographic printing plate 52 is carried to a transfer mechanism I' accompanying the rotation of the plate cylinder 124. The transfer mechanism I', in cooperation with a paper feed roller 135 guide rollers 136 and 137, and a guide plate 138 of a transfer material feed mechanism J', carries a sheet of transfer material 62 cut into a predetermined size simultaneously with the conveyance of the dry planograhic printing plate 52 and at a speed equal to the peripheral speed of the plate cylinder 124, pringing the transfer material 134 into contact with the dry planographic printing plate 52. Thereupon a corona charger 139 gives the back of the transfer material 134 a corona discharge of polarity opposite to that of the toner 130. The toner-transferred transfer material 134 is then removed from the dry planographic printing plate 52 by means of a pawl 140, transmitted to a toner-fixation mechanism K' by means of a conveyor belt 141, fixed by means of heat-fixing rollers 142 and 143, delivered to a delivery mechanism L' and piled up in a delivered transfer material receptacle 144. The heat-fixing rollers 142 and 143 are treated with silicone rubber or Teflon, and the roller 142 is supplied with silicone oil from a silicone oil reservoir 145. Thereafter, the dry planographic printing plate 52 is again carried to the charging mechanism G', and sheets of transfer material 134 are successively subjected to the dry planographic printing by repeating the above-mentioned operations. After a fixed quantity is printed, the dry planographic printing plate 52 is delivered to a plate takeout mechanism M', where it is set free with the catches 125 and 127 opened, removed from the plate cylinder 124 by the operation of the stripper 147, and delivered on to a receiver 150 through plate takeout rollers 148 and 146, thus completing the processes for dry planographic printing.

Finally, there will be described a dry planographic printing apparatus according to a fourth embodiment of the invention. This apparatus, as compared with the third apparatus, is more suitable for the production of high-precision prints with a striking contrast. That is, in this fourth apparatus, a xenon flash irradiation mechanism (not shown) for flashing a xenon flash lamp at the whole surface of the fixed photosensitive plate 30 is interposed between the fixation mechanism E' for fixing the conductive toner 47 to the photosensitive plate 30 and the divergence mechanism P' of the third apparatus as shown in FIG. 14.

This invention, with such construction as described above, has various effects given as follows.

The dry planographic printing plate available for the dry planographic printing method obtained according to the invention may be prepared by forming, by an electrophotographic method, a conductive toner image on the photosensitive plate which includes the electrically conductive support such as zinc oxide coated paper and the photo-conductive layer formed on the support and composed of the resin binder and photoconductive powder dispersed therein, then fixing the conductive toner image, and further flush-irradiating at need the whole surface of the photosensitive plate by means of the xenon flash lamp. Therefore, this dry planographic printing plate may enable large-quantity printing and provide secure prints, which is its outstanding advantage over the conventional method such as electrostatic chemography and organic memory coating that has limited the quantity of prints produced and has not always secured stable prints. In addition, the image itself can be formed at the sensitivity of an electrophotographic apparatus, so that the dry planographic printing plate may be prepared from a reflecting original, ensuring very easy and low-cost production. Further, the dry planographic printing method employing this dry planographic printing plate is expected to eliminate the troublesome problems, such as moistening, control of the amount of ink used, cleaning of printing machines after use, etc., in the small offset printing method presently prevalent for the office service. In particular, the dry planographic printing plate is characterized by its requiring neither exposure portion nor cleaning portion at the printing section. The dry planographic printing plate requires no cleaning portion because it involves the reversal development in which toner has a charge of the same polarity as that of the charge on the printing plate. Thus, the life of the dry planographic printing plate is prolonged, and the loss of toner is prevented. Moreover, the elimination of the exposure portion may lead to the speed-up of the printing operation.

Meanwhile, the dry printing apparatus as shown in FIG. 14 is provided with the exposure mechanism capable of selectively exposing the printing plate to a normal or reverse image by replacing between the in-mirror lens and the in-prism lens. With such printing apparatus, hard copies may be produced by exposing photosensitive plates to the normal image in case only a small number of copies are needed, while, if a large number of copies are required, a dry planographic printing plate may be obtained by exposing the photosensitive plate to the reverse image, a large number of copies being produced at low cost in a relatively short time by repeating the dry planographic printing processes by means of the dry planographic printing plate.

Thus, the practical effects of this invention are immeasurable.

Examples of this invention are given as follows.

Example 1

A disperse solution of 100 weight parts of photoconductive zinc oxide, 15 of acrylic resin, 5 of silicone resin, 0.01 of rose bengal, and 100 of toluene, which had been triturated in a ball mill for 12 hours, was applied approximately 15μ thick to a conductive-treated paper coated with polydimethyldiallyl-ammonium chloride, thus preparing a photosensitive plate.

Subsequently, a reverse latent electrostatic image was obtained by giving a negative corona charge (−6 kV) to the photosensitive plate in a dark place, thereby uniformly negatively charging the photosensitive plate, and then exposing the photosensitive plate to a reverse image of an original (visible radiation). Thereafter, a conductive toner of the following composition was stuck to a magnet and developed.

| | |
|---|---|
| Magnetite: | 30 weight parts |
| Carbon black: | 15 weight parts |
| Polystyrene: | 35 weight parts |
| Dianix Navy Blue ER-FS (Disperse dye from Mitsubishi Chemical Industries, Ltd.) | 20 weight parts |

A mixture of the above composition was mixedly dispersed and homogenized on two rollers, and further pulverized in a jet mill. Further, groups of unsuitably large or small particles were removed by classification, thus preparing a conductive toner with the mean particle sixe of 10μ. The pressurized conductive toner has an electric conductivity of approximately $10^5$ Ωcm. This conductive toner adhered to unexposed portions retaining the negative charge. Then, the toner was heat-fixed by means of a hot roller (approx. 150° C.) coated with silicone rubber. In this photosensitive plate the conductive toner portion (image portion) may become an electrostatically conductive portion, so that the photosensitive plate can be used as a dry planographic printing plate.

When this dry planographic printing plate was uniformly negatively corona-charged (−6 kV) in a dark place, the charge on the conductive toner image portion escaped, the negative charge remaining at the non-image portion alone.

Subsequently, when the dry planographic printing plate was reversal-developed with a negative-type toner by the magnetic brush method, the toner adhered to the conductive toner image portion retaining no negative charge.

Thereafter, a sheet of paper was placed on the dry planographic printing plate and given a corona charge (+5.8 kV) at the back, and the toner was electrostatic-transferred to the sheet and heat-fixed, thereby producing a print. A large number of prints could be otained by repeating this dry planographic printing method.

Example 2

A disperse solution of 100 weight parts of photoconductive zince oxide powder, 20 of styrene-butadiene copolymer, 0.01 of rose bengal, and 150 of toluene, which had been triturated in a ball mill for 12 hours, was applied approximately 15μ thick to an aluminium backing plate (150μ thick) coated with polyvinyl alcohol 3μ thick, thus preparing a photosensitive plate.

Subsequently, a reverse latent electrostatic image was obtained by giving a negative corona charge (−6 kV) to the photosensitive plate in a dark place, thereby uniformly negatively charging the photosensitive plate, and then exposing the photosensitive plate to a reverse image of an original (visible radiation). Thereafter, a conductive toner of the following composition was stuch to a magnet and developed.

| | |
|---|---|
| Magnetite: | 50 weight parts |
| Carbon black: | 10 weight parts |
| Polystyrene: | 15 weight parts |
| Epoxy resin (AER664 from Asahi Chemical Industry Co., Ltd.) | 15 weight parts |
| Duranol Blue G (Disperse dye from Imperial Chemical Industry Co., Ltd.) | 15 weight parts |

A mixture of the above composition was prepared in the same manner as in Example 1. This conductive toner has the mean particle size of 15μ and electrical conductivity of approximately $10^7$ Ωcm. Then, the toner was heat-fixed by means of a hot roller. When the whole surface of the photosensitive plate was flash-irradiated by a xenon flash lamp (from Comet Corporation) with the input energy of 1,200 Wsec., the conductive tone penetrated into the photoconductive layer of the photosensitive plate to form an electrically conductive portion. Thus, the photosensitive plate in a dark place was given a permanently electrically conductive pattern composed of an electrically conductive portion and an electrically insulating portion. This plate is to be used as a dry planographic printing plate. Thereafter, employing this dry planographic printing plate a large number of prints could be obtained in accordance with the same dry planographic printing method as that of Example 1.

Example 3

A disperse solution of 100 weight parts of zinc oxide, 15 of silicone resin (from The Shin-etsu Chemical Industry Co., Ltd.), 5 of cyclized rubber, 0.01 of rose bengal, and 100 of toluene, which had been triturated in a ball mill for 12 hours, was applied to a polyester film (approx. 100μ thick) vacuum-evaporated with aluminium, thus preparing a photosensitive plate.

A conductive toner of the following composition was prepared in the same manner as in Example 1.

| | |
|---|---|
| Magnetite: | 35 weight parts |
| Carbon black: | 15 weight parts |
| Polystyrene: | 40 weight parts |
| Sumikaron Violet E-RL (Disperse dye from Sumitomo Chemical Co., Ltd.) | 20 weight parts |

The conductive toner of the above composition has the mean particle size of 15μ and electrical conductivity of approximately $10^5$ Ωcm.

Employing this conductive toner, a dry planographic printing plate was prepared in the same manner as in Example 1, and a large number of prints could be obtained in accordance with the same dry planographic printing method as that of Example 1.

Example 4

| | |
|---|---|
| Polystyrene: | 30 weight parts |
| Polymethylmethacrylate | 20 weight parts |

-continued

| | |
|---|---|
| Carbon Black: | 10 weight parts |
| Magnetite | 40 weight parts |

A mixture of the above composition was placed in a mixed solvent of cyclohexane and chloroform at a content ratio of 4:1, mixed and dispersed in a ball mill, and spray-dried, thus preparing a conductive toner with the particle size of some 15μ. Employing this conductive toner, a photosensitive plate was charged and exposed in the same manner as in Example 1, and then developed and heat-fixed, thus preparing a dry planographic printing plate. Thereafter, a large number of prints could be obtained in accordance with the same dry planographic printing method as that of Example 1.

Example 5

22 weight parts of polystyrene and 22 of polyhexamethylene sebacate were dissolved in a mixed solvent of cyclohexane and chloroform at a content ratio of 4:1. Then, 11 weight parts of carbon black and 45 of magnetite were dispersed in this solution while agitating the solution strongly, and spray-dried, thus preparing a conductive press-fussed toner with the particle sixe of some 15μ. Subsequently, employing this conductive toner, the same photosensitive plate as that of Example 1 was charged, exposed and developed in the same manner as in Example 1, and then passed through a pair of metal rollers with the inter-roller pressure of 100 kg/cm$^2$ for fixation, thus preparing a dry planographic printing plate. Thereafter, a large number of prints could be obtained in accordance with the same dry planographic printing method as that of Example 1.

Example 6

| | |
|---|---|
| Microwax L-700 (Mitsui Petrochemical Industries, Ltd.): | 34 weight parts |
| Ethylene-vinyl-acetate copolymer (EV-420 from Mitsui Polychemical): | 11 weight parts |
| Carbon black: | 7 weight parts |
| Magnetite (Titan Kogyo Kabushiki Kaisha): | 48 weight parts |

A mixture of the above composition was mixedly dispersed and homogenized on two rollers, and further pulverized in a jet mill. Further, a conductive press-fussed toner with the mean particle size of 15μ was prepared by classification.

Employing this conductive toner, the same photosensitive plate as that of Example 3 was charged, exposed, and developed in the same manner as in Example 2, passed through a pair of metal rollers with the inter-roller pressure of 100 kg/cm$^2$ for fixation, and then flash-irradiated by a xenon flash lamp, thus preparing a dry planographic printing plate. Thereafter, a large number of prints could be obtained in accordance with the same dry planographic printing method.

What we claim is:

1. A dry planographic printing method comprising charging the surface of a dry planographic printing plate, reversal-developing said printing plate by means of a toner, transferring said toner to a transfer material, and fixing said toner; said dry planographic printing plate being prepared by charging and image-exposing a photosensitive plate including an electrically conductive support and a photoconductive layer formed on said support, said photoconductive layer comprising a resin binder and a photoconductive powder dispersed in said binder; and then developing said photosensitive plate by means of a conductive toner and fixing said conductive toner.

2. A dry planographic printing method according to claim 1, wherein said photoconductive layer consists essentially of said resin binder and said photoconductive powder disbursed in said binder.

3. A dry planographic printing method comprising charging the surface of a dry planographic printing plate, reversal-developing said printing plate by means of a toner, transferring said toner to a transfer material, and fixing said toner; said dry planographic printing plate being prepared by charging and image-exposing a photosensitive plate including an electrically conductive support and a photoconductive layer formed on said support, said photoconductive layer comprising of a resin binder and a photoconductive powder dispersed in said binder; then developing said photosensitive plate by means of a conductive toner and fixing said conductive toner, and finally flash-irradiating the whole surface of said photosensitive plate by means of a xenon flash lamp.

4. A dry planographic printing method according to claim 3, wherein said photoconductive layer consists essentially of said resin binder and said photoconductive powder disbursed in said binder.

* * * * *